US010830454B2

(12) United States Patent
Armstrong et al.

(10) Patent No.: US 10,830,454 B2
(45) Date of Patent: Nov. 10, 2020

(54) VENTILATION SYSTEMS HAVING RECONFIGURABLE AIRFLOW FEATURES

(71) Applicant: Haier US Appliance Solutions, Inc., Wilmington, DE (US)

(72) Inventors: James Lee Armstrong, Louisville, KY (US); Michael A. Funk, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 92 days.

(21) Appl. No.: 15/993,674

(22) Filed: May 31, 2018

(65) Prior Publication Data

US 2019/0368746 A1 Dec. 5, 2019

(51) Int. Cl.
*F24C 15/20* (2006.01)

(52) U.S. Cl.
CPC ..... *F24C 15/2042* (2013.01); *F24C 15/2071* (2013.01)

(58) Field of Classification Search
CPC .. F24C 15/20; F24C 15/2042; F04D 29/4246; F24F 13/10; Y10T 137/87812
See application file for complete search history.

(56) References Cited

U.S. PATENT DOCUMENTS 3,075,335 A * 1/1963 Bandlow ..... F24C 15/20 55/385.1
3,125,869 A * 3/1964 Winton ..... F24C 15/20 62/317
3,145,643 A * 8/1964 Strouth ..... F24C 15/20 126/299 D
3,194,146 A * 7/1965 Jenson ..... F24C 15/2021 126/299 D
4,083,361 A * 4/1978 Bergmark ..... F04D 25/12 126/299 D
4,083,362 A * 4/1978 Bergmark ..... F04D 25/12 126/299 D
4,088,123 A * 5/1978 Bowen, Jr. ..... F24C 15/20 126/299 D
4,089,328 A * 5/1978 Bergmark ..... F24C 15/20 126/299 D
4,133,300 A * 1/1979 Burton, Jr. ..... F24C 15/20 126/299 D
4,146,016 A 3/1979 Bowen, Jr. et al.
4,266,528 A * 5/1981 Barnhart ..... F24C 15/20 126/299 D
4,682,580 A * 7/1987 Fukumoto ..... F24C 15/20 126/299 D
5,738,083 A * 4/1998 Pettinari ..... F24C 15/20 126/299 D (Continued)

*Primary Examiner* — Jorge A Pereiro
(74) *Attorney, Agent, or Firm* — Dority & Manning, P.A.

(57) ABSTRACT

A ventilation system for a cooktop appliance comprising a cooktop surface. The ventilation system defines a vertical direction, a lateral direction, and a transverse direction. The ventilation system includes a casing positioned above and spaced apart from the cooktop appliance along the vertical direction with an image monitor supported on the casing at a front end of the casing. The ventilation system is selectively configurable to provide fluid communication from an air inlet to one of a recirculation outlet, a first exhaust outlet, and a second exhaust outlet without removing or rearranging an air handler of the ventilation system.

18 Claims, 8 Drawing Sheets

(56) References Cited

U.S. PATENT DOCUMENTS

| | | | | |
|---|---|---|---|---|
| 5,981,929 | A * | 11/1999 | Maeda | H05B 6/6429 126/299 D |
| 6,218,654 | B1 | 4/2001 | Braunisch | |
| 8,074,637 | B2 * | 12/2011 | Yamauchi | F24C 15/2021 126/299 D |
| 8,783,245 | B2 * | 7/2014 | Saraf | F24C 15/2021 126/299 D |
| 9,057,527 | B2 | 6/2015 | Oagley et al. | |
| 2013/0233295 | A1 * | 9/2013 | Oagley | F24C 15/20 126/299 D |

* cited by examiner

VENTILATION SYSTEMS HAVING RECONFIGURABLE AIRFLOW FEATURES

FIELD OF THE INVENTION

The present subject matter relates generally to systems for aiding cooking operations, and more particularly to systems for enhancing cooking engagement and convenience with a cooktop appliance.

BACKGROUND OF THE INVENTION

Cooktop or range appliances generally include heating elements for heating cooking utensils, such as pots, pans, and griddles. A variety of configurations can be used for the heating elements located on the cooking surface of the cooktop. The number of heating elements or positions available for heating on the range appliance can include, for example, four, six, or more depending upon the intended application and preferences of the buyer. These heating elements can vary in size, location, and capability across the appliance.

Unfortunately, existing systems can provide an unsatisfactory user experience and can inhibit a user's desired interactions. Recipe books are often cumbersome and difficult to use while cooking. Pages may rip, stain, burn, or become otherwise damaged during use. Moreover, printed materials do not allow for immediate real-time guidance or information. Electronic devices that are connected to the Internet, such as a computer, tablet, or smartphone, may allow for immediate interaction with remote information servers or individuals. However, such devices are generally not suitable for use in tandem with a cooktop appliance. A user may be forced to repeatedly move away from the cooktop appliance in order to view the device or provide any input instructions. Moreover, the extreme environment near a cooktop appliance may risk damaging the device. For instance, a display of the device may be rendered unusable. In particular, food or steam may obscure the display. In some cases, heat or exhaust fumes may be directed to the display, increasing the potential for display failure.

A user engagement system may be provided for facilitating user engagement and interaction during use of a cooktop appliance. The user engagement system may be provided above the cooktop appliance. Such systems may include a ventilation system having a large fan in order to move a large amount of air in the quietest way possible. Typically, the ventilation system may be selectively configured to recirculate air within the room or to exhaust the air to an external environment. Some ventilation systems are selectively configurable by repositioning the fan to direct exhaust in the desired direction. However, large fans are not easily repositioned when installing or configuring the user engagement system.

As a result, improved systems are needed for facilitating installation or modification of a user engagement system. In particular, it may be advantageous to provide a user engagement system including ventilation features which can be readily reconfigured for recirculation or exhaust.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a ventilation system for a cooktop appliance comprising a cooktop surface is provided. The ventilation system defines a vertical direction, a lateral direction, and a transverse direction. The ventilation system includes a casing positioned above and spaced apart from the cooktop appliance along the vertical direction with an image monitor supported on the casing at a front end of the casing. The ventilation system also includes a ventilation assembly. The ventilation assembly includes an air inlet defined in a bottom end of the casing facing the cooktop surface of the cooktop appliance, a recirculation outlet defined in a top end of the casing proximate the front end of the casing, a first exhaust outlet defined in the top end of the casing proximate a back end of the casing, and a second exhaust outlet defined in the back end of the casing proximate the top end of the casing. The ventilation assembly also includes an air handler fixedly mounted within the casing in fluid communication with the air inlet to motivate an airflow therethrough. The ventilation assembly is selectively configurable to provide fluid communication from the air inlet to one of the recirculation outlet, the first exhaust outlet, and the second exhaust outlet.

In another exemplary aspect of the present disclosure, a ventilation system for a cooking engagement system for a cooktop appliance is provided. The ventilation system includes a casing that defines a vertical direction, a lateral direction, and a transverse direction. The ventilation system also includes an air inlet defined in a bottom end of the casing facing the cooktop appliance, a recirculation outlet defined in a top end of the casing proximate a front end of the casing, a first exhaust outlet defined in the top end of the casing proximate a back end of the casing, and a second exhaust outlet defined in the back end of the casing proximate the top end of the casing. The ventilation system also includes an air handler fixedly mounted within the casing in fluid communication with the air inlet to motivate an airflow therethrough. The ventilation system is selectively configurable to provide fluid communication from the air inlet to one of the recirculation outlet, the first exhaust outlet, and the second exhaust outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
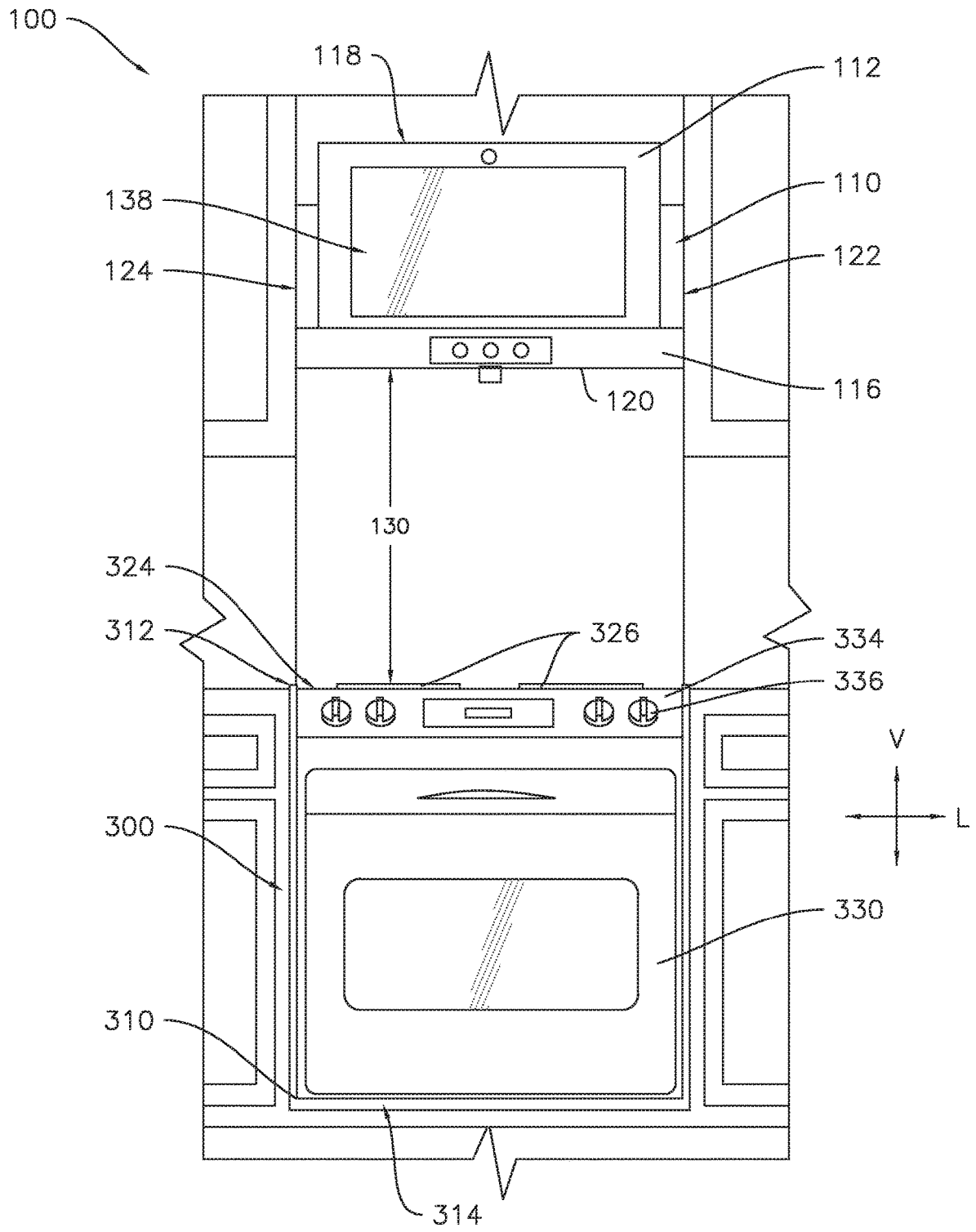
FIG. 1 provides a front view of a system according to one or more exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
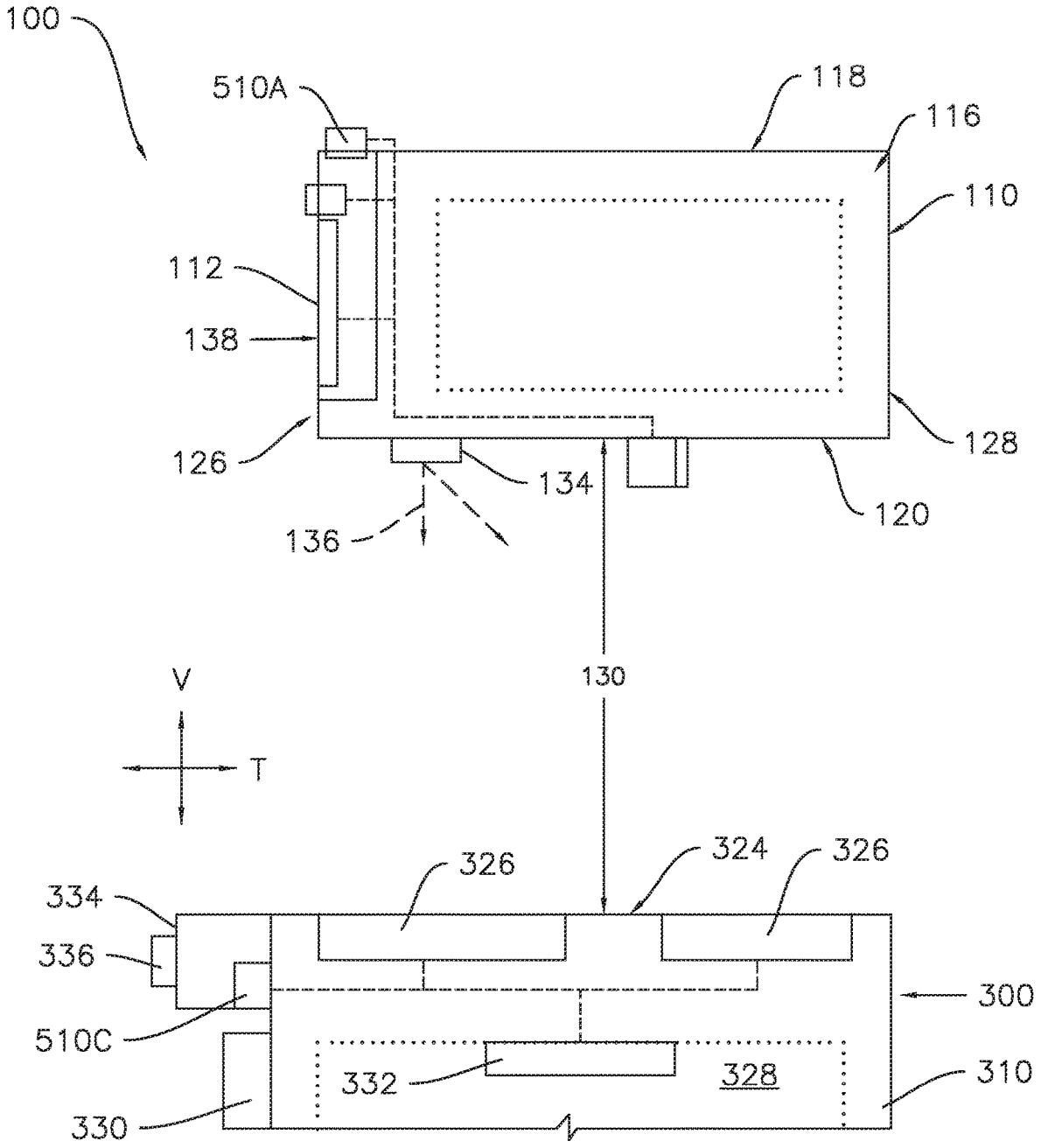
FIG. 2 provides a side schematic view of the exemplary system of FIG. 1.

Turning to the figures, FIGS. 1 and 2 provide various views of a system 100 according to exemplary embodiments of the present disclosure. System 100 generally includes an interactive assembly 110 having a controller 510A in operable communication with an image monitor 112 that is generally positioned above a cooktop appliance 300.

As shown, cooktop appliance 300 defines a vertical direction V, a lateral direction L, and a transverse direction T, for example, at a cabinet 310. The vertical, lateral, and transverse directions V, L, and T are mutually perpendicular and form an orthogonal direction system. As shown, cooktop appliance 300 extends along the vertical direction V between a top portion 312 and a bottom portion 314, along the lateral direction L between a left side portion and a right side portion; and along the traverse direction T between a front portion and a rear portion.

Cooktop appliance 300 can include a chassis or cabinet 310 and a cooktop surface 324 having one or more heating elements 326 for use in, for example, heating or cooking operations. In one example embodiment, cooktop surface 324 is constructed with ceramic glass. In other embodiments, however, cooktop surface 324 may include any another suitable material, such as a metallic material (e.g., steel) or another suitable non-metallic material. Heating elements 326 may be various sizes and may employ any suitable method for heating or cooking an object, such as a cooking utensil (not shown), and its contents. In one embodiment, for example, heating element 326 uses a heat transfer method, such as electric coils or gas burners, to heat the cooking utensil. In another embodiment, however, heating element 326 uses an induction heating method to heat the cooking utensil directly. In turn, heating element 326 may include a gas burner element, resistive heat element, radiant heat element, induction element, or another suitable heating element.

In some embodiments, the cabinet 310 may be insulated and may define a cooking chamber 328 selectively enclosed by a door 330. One or more heating elements 332 (e.g., top broiling elements or bottom baking elements) may be positioned within cabinet 310 to heat cooking chamber 328. Heating elements 332 within cooking chamber 328 may be provided as any suitable element for cooking the contents of cooking chamber 328, such as an electric resistive heating element, a gas burner, a microwave element, a halogen element, etc. Thus, cooktop appliance 300 may be referred to as an oven range appliance. As will be understood by those skilled in the art, cooktop appliance 300 is provided by way of example only, and the present subject matter may be used in the context of any suitable cooking appliance, such as a double oven range appliance or a standalone cooktop (e.g., fitted integrally with a surface of a kitchen counter). Thus, the example embodiments illustrated and described are not intended to limit the present subject matter to any particular cooking chamber or heating element configuration, except as otherwise indicated.

As illustrated, a user interface panel 334 may be provided on cooktop appliance 300. Although shown at front portion of cooktop appliance 300, another suitable location or structure (e.g., a backsplash) for supporting user interface panel 334 may be provided in alternative embodiments. In some embodiments, user interface panel 334 includes input components or controls 336, such as one or more of a variety of electrical, mechanical, or electro-mechanical input devices. Controls 336 may include, for example, rotary dials, knobs, push buttons, and touch pads. A controller 510C is in communication with user interface panel 334 and controls 336 through which a user may select various operational features and modes and monitor progress of cooktop appliance 300. In additional or alternative embodiments, user interface panel 334 includes a display component, such as a digital or analog display in communication with a controller 510C and configured to provide operational feedback to a user. In certain embodiments, user interface panel 334 represents a general purpose I/O ("GPIO") device or functional block.

As shown, controller 510C is communicatively coupled (i.e., in operative communication) with user interface panel 334 and its controls 336. Controller 510C may also be communicatively coupled with various operational components of cooktop appliance 300 as well, such as heating elements (e.g., 326, 332), sensors, and the like. Input/output ("I/O") signals may be routed between controller 510C and the various operational components of cooktop appliance 300. Thus, controller 510C can selectively activate and operate these various components. Various components of cooktop appliance 300 are communicatively coupled with controller 510C via one or more communication lines such as, for example, conductive signal lines, shared communication busses, or wireless communications bands.

In some embodiments, controller 510C includes one or more memory devices and one or more processors. The processors can be any combination of general or special purpose processors, CPUs, or the like that can execute programming instructions or control code associated with operation of cooktop appliance 300. The memory devices (i.e., memory) may represent random access memory such as DRAM or read only memory such as ROM or FLASH. In one embodiment, the processor executes programming instructions stored in memory. The memory may be a separate component from the processor or may be included onboard within the processor. Alternatively, controller 510C may be constructed without using a processor, for example, using a combination of discrete analog or digital logic circuitry (such as switches, amplifiers, integrators, comparators, flip-flops, AND gates, and the like) to perform control functionality instead of relying upon software.

In certain embodiments, controller 510C includes a network interface such that controller 510C can connect to and communicate over one or more networks with one or more network nodes. Controller 510C can also include one or more transmitting, receiving, or transceiving components for transmitting/receiving communications with other devices communicatively coupled with cooktop appliance 300. Additionally or alternatively, one or more transmitting, receiving, or transceiving components can be located off-board of controller 510C. Generally, controller 510C can be positioned in any suitable location throughout cooktop appliance 300. For example, controller 510C may be located proximate user interface panel 334 toward front portion of cooktop appliance 300.

In some embodiments, cooktop controller 510C is provided as or as part of controller 510A. In alternative embodiments, cooktop controller 510C is a discrete unit in selective operable communication with controller 510A (e.g., through one or more wired or wireless channels).

As shown, one or more casings (e.g., hood casing 116) may be provided above cooktop appliance 300 along the vertical direction V. For example, a hood casing 116 may be positioned above cooktop appliance 300. Hood casing 116 includes a plurality of outer walls and generally extends along the vertical direction V between a top end 118 and a bottom end 120, along the lateral direction L between a right side end 122 and a left side end 124, e.g., "right" and "left" as used herein refer to from a perspective of a user standing in front of system 100. The hood casing 116 may also extend along the transverse direction T between a front end 126 and a back end 128. In some embodiments, hood casing 116 is spaced apart from cooktop surface 324 along the vertical direction V. An open region 130 may thus be defined along the vertical direction V between cooktop surface 324 and bottom end 120.

In optional embodiments, hood casing 116 is formed as a range hood. As will be described in detail below, a ventilation assembly 200 (e.g., FIGS. 4 through 8) within hood casing 116 may thus direct an airflow from the open region 130 and through hood casing 116. However, a range hood is provided by way of example only. Other configurations may be used within the spirit and scope of the present disclosure. For example, although a generally rectangular shape is illustrated, any suitable shape or style may be adapted to form the structure of hood casing 116.

In some embodiments, a lighting assembly 134 is provided above cooktop surface 324 (e.g., along the vertical direction V). For instance, lighting assembly 134 may be mounted to hood casing 116 (e.g., directly above cooktop surface 324). Generally, lighting assembly 134 includes one or more selectable light sources directed toward cooktop surface 324. In other words, lighting assembly 134 is oriented to project a light (as indicated at arrows 136) to cooktop appliance 300 through open region 130 and illuminate at least a portion of cooktop surface 324. The light sources may include any suitable light-emitting elements, such as one or more light emitting diode (LED), incandescent bulb, fluorescent bulb, halogen bulb, etc.

During use, lighting assembly 134 may be selectively activated to illuminate a portion of cooktop appliance 300 (e.g., cooktop surface 324) based on a received light visibility signal. For instance, lighting assembly 134 may be activated by controller 510A based on direct user input (e.g., depressing a dedicated switch, a gesture control signal, voice control signal, etc.). In other words, the light visibility signal may be an isolated user input signal. Alternatively, the light visibility signal may be an automatically-generated signal that does not require direct user input. The light visibility signal may indicate additional light is needed above cooktop appliance 300. In turn, controller 510A may automatically activate lighting assembly 134 based on a determined condition. Optionally, one or more camera assemblies may be mounted to hood casing 116 and directed toward cooktop appliance 300 or an area in front of cooktop appliance 300 (e.g., to operate with or independently of lighting assembly 134).

In some embodiments, image monitor 112 is provided above cooktop surface 324 (e.g., along the vertical direction V). For instance, image monitor 112 may be mounted to or supported on hood casing 116 (e.g., directly above cooktop surface 324) proximal to the front end 126. Generally, image monitor 112 may be any suitable type of mechanism for visually presenting a digital (e.g., interactive) image. For example, image monitor 112 may be a liquid crystal display (LCD), a plasma display panel (PDP), a cathode ray tube (CRT) display, etc. Thus, image monitor 112 includes an imaging surface 138 (e.g., screen or display panel) at which the digital image is presented or displayed as an optically-viewable picture (e.g., static image or dynamic video) to a user. Optionally, a protective transparent panel (e.g., formed from a transparent glass, plastic, etc.) may be positioned across or over imaging surface 138. In some such embodiments, the protective transparent panel is mounted within or supported on hood casing 116 forward from imaging surface 138 along the transverse direction T.

The optically-viewable picture at the imaging surface 138 may correspond to any suitable signal or data received or stored by interactive assembly 110 (e.g., at controller 510A). As an example, image monitor 112 may present recipe information in the form of viewable text or images. As another example, image monitor 112 may present a remotely captured image, such as a live (e.g., real-time) dynamic video stream received from a separate user or device. As yet another example, image monitor 112 may present a graphical user interface (GUI) that allows a user to select or manipulate various operational features of interactive assembly 110 or cooktop appliance 300. During use of such GUI embodiments, a user may engage, select, or adjust the image presented at image monitor 112 through any suitable input, such as gesture controls detected through a camera assembly, voice controls detected through one or more microphones, associated touch panels (e.g., capacitance or resistance touch panel) sensors overlaid across imaging surface 138, or any other suitable input.

As illustrated, the imaging surface 138 is directed toward the area forward from the cooktop appliance 300. During use, a user standing in front of cooktop appliance 300 may thus see the optically-viewable picture (e.g., recipe, dynamic video stream, graphical user interface, etc.) displayed at the imaging surface 138. Optionally, the imaging surface 138 may be positioned at a rearward non-orthogonal angle relative to the vertical direction V. In other words, the imaging surface 138 may be inclined such that an upper edge of the imaging surface 138 is closer to the rear end 128 of hood casing 116 than a lower edge of the imaging surface 138 is. In some such embodiments, the non-orthogonal angle is between 1° and 15° relative to the vertical direction V. In certain embodiments, the non-orthogonal angle is between 2° and 7° relative to the vertical direction V.

Figure 3:
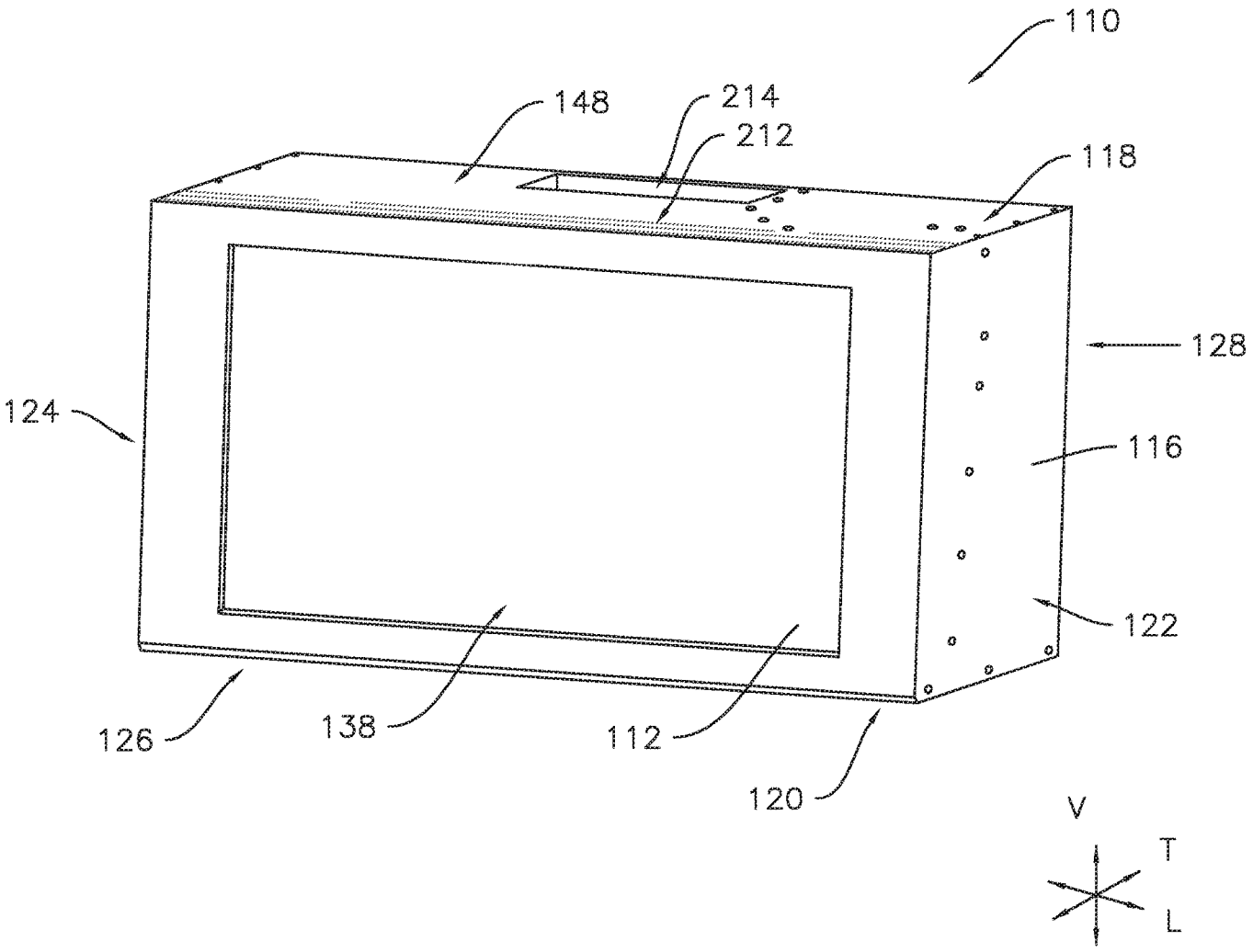
FIG. 3 provides a perspective view of an interactive assembly according to one or more exemplary embodiments of the present disclosure which may be incorporated into a system such as the system of FIG. 1.

Turning now to FIG. 3, a perspective view of an exemplary embodiment of the interactive assembly 110 in isolation, e.g., without adjacent cabinetry or appliances, is provided. As shown, hood casing 116 extends in the vertical direction V from a top end 118 to a bottom end 120, the transverse direction T between a front end 126 and the rear end 128, and in the lateral direction L from the first side end 122 to a second side end 124. One or more air outlets 212 may be defined by hood casing 116 (e.g., through one or more external walls of hood casing 116) for use in configurations wherein the ventilation system provides recirculation, as described in more detail below. As shown for example in FIG. 3, air outlets 212 defined through hood casing 116 may be defined through hood casing 116 at the top end 118. For example, the top end 118 of the casing 116 may be defined by a top wall 148.

Figure 4:
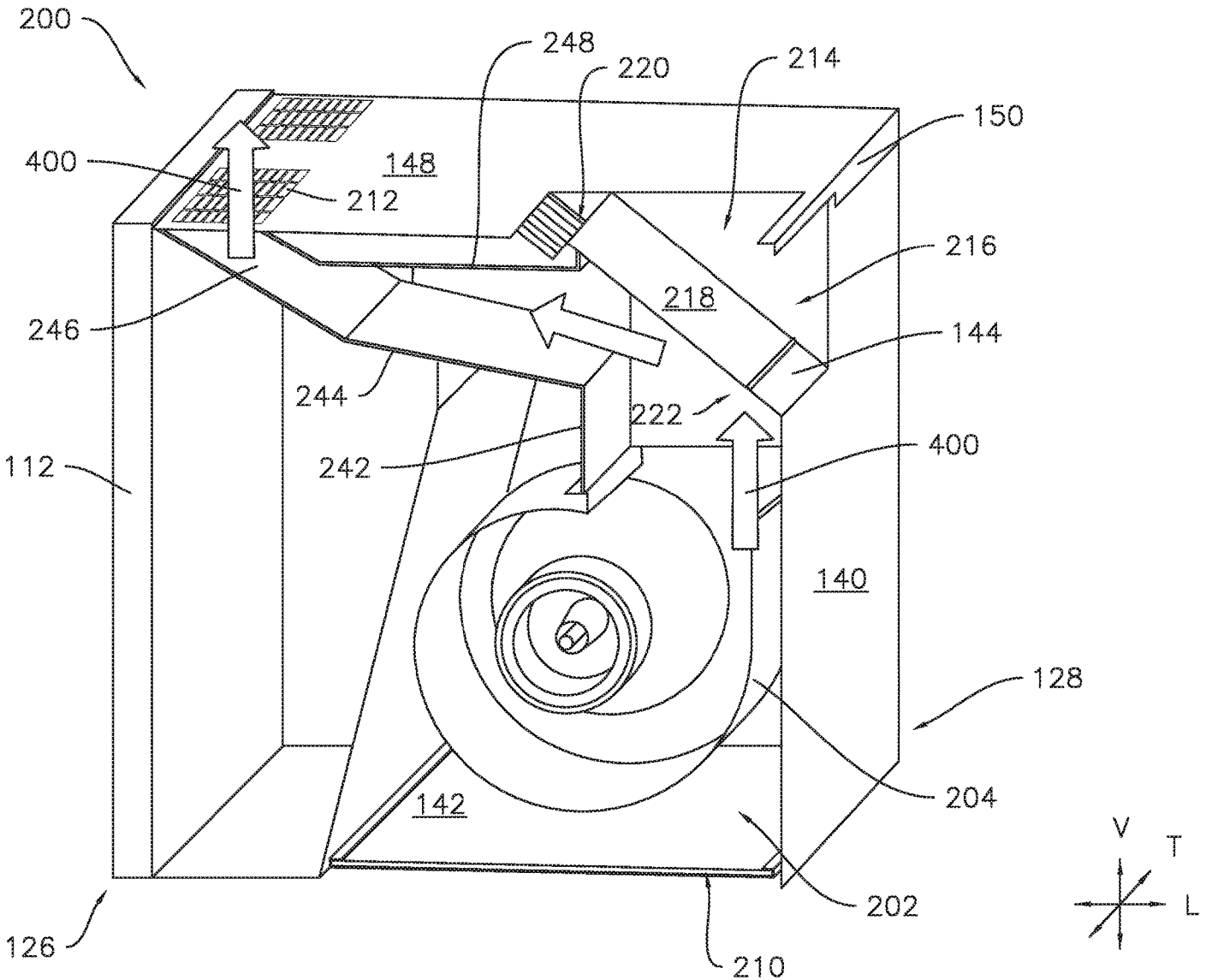
FIG. 4 provides a partially sectioned perspective view of the interactive of FIG. 3 with a removable air guide in an oblique position.
Figure 5:
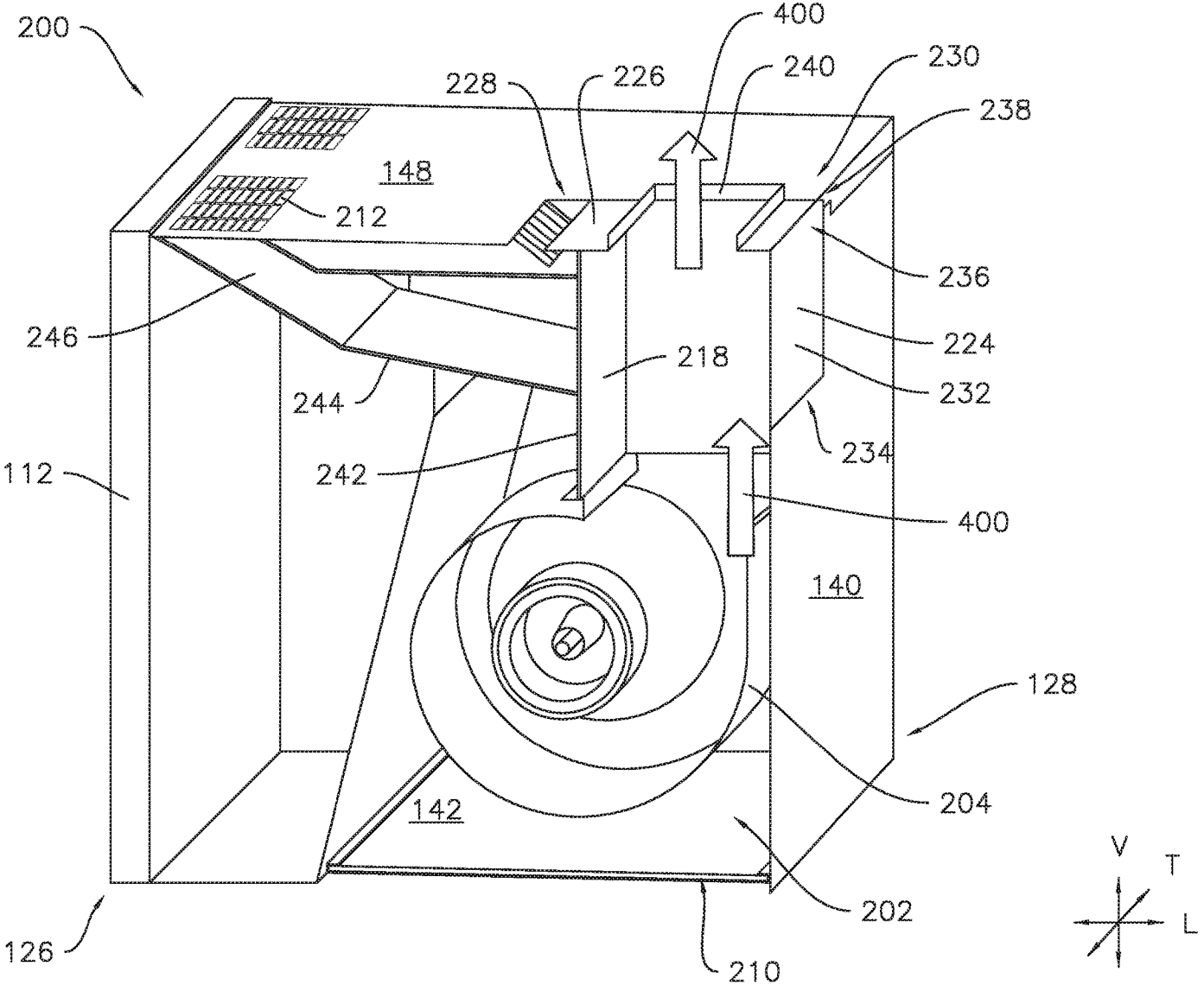
FIG. 5 provides a partially sectioned perspective view of the interactive assembly of FIG. 3 with the removable air guide in a vertical position and an external vent attachment in a vertical position.
Figure 6:
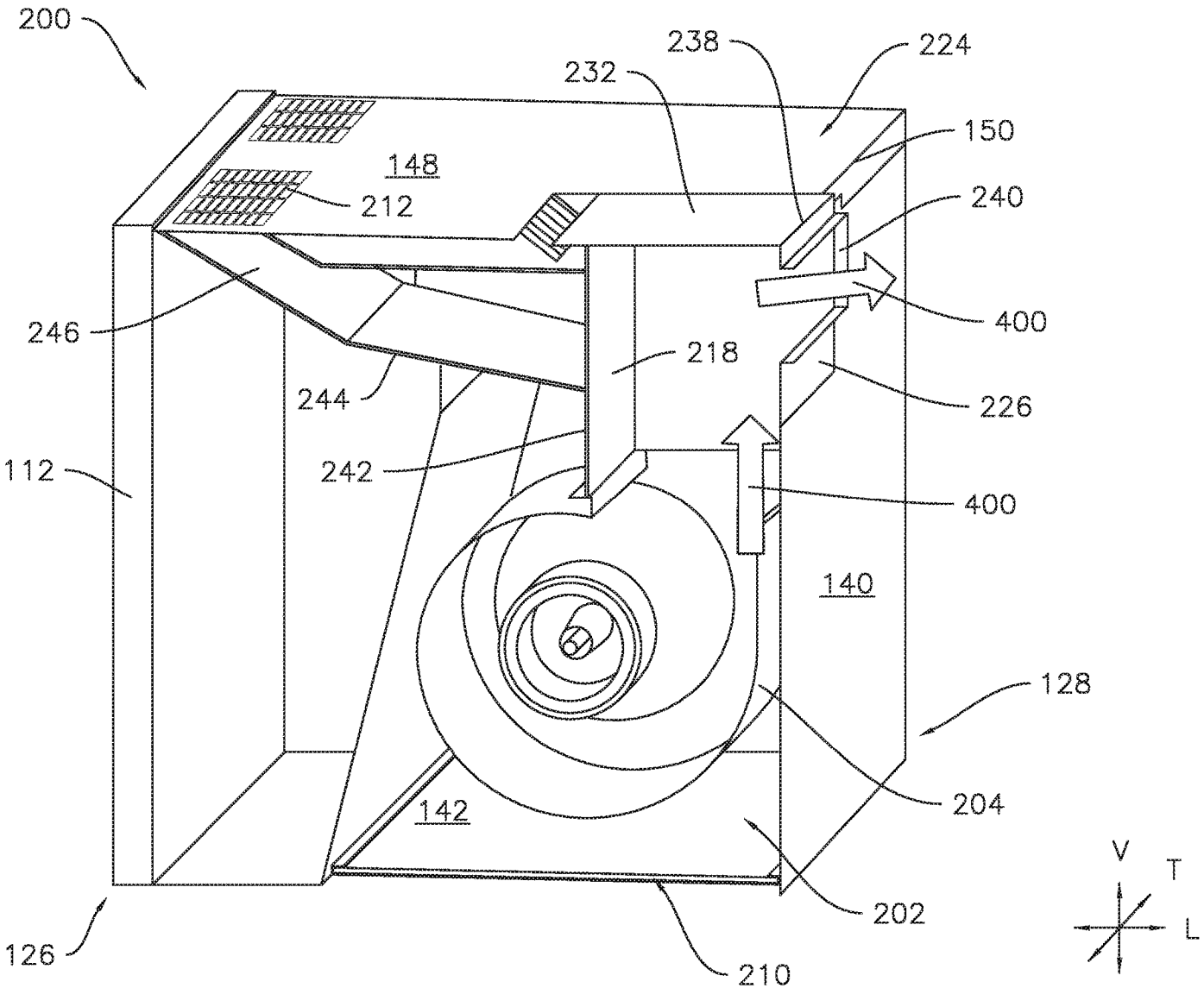
FIG. 6 provides a partially sectioned perspective view of the interactive assembly of FIG. 3 with the removable air guide in the vertical position and the external vent attachment in a transverse position.

As shown in FIGS. 4 through 6, a ventilation system 200 may generally extend between one or more air inlets 210 defined in the bottom end 120 of the casing 116 and air outlets 212, 214, and 216. For example, the bottom end 120 of the casing 116 may face the cooktop surface 324 of the cooktop appliance 300. The bottom end 120 of the casing 116 may be defined by a bottom wall 142. The air outlets 212, 214, and 216 may include a recirculation outlet 212 defined in the top end 118 of the casing 116 proximate the front end 126 of the casing 116, a first exhaust outlet 214 defined in the top end 118 of the casing 116 proximate the back end 128 of the casing 116, and a second exhaust outlet 216 defined in the back end 128 of the casing 116 proximate the top end 118 of the casing 116. The ventilation system 200 may also include an air handler 204 fixedly mounted within the casing 116 in fluid communication with the air inlet 210 to motivate a flow of air 400 through the casing 116. The air handler 204 may be "fixedly" mounted within the casing 116 in that the air handler 204 is not readily removed from or repositioned within the casing 116. For example, the fixedly mounted air handler 204 may provide only a single direction of airflow through the casing 116. Accordingly, the ventilation system 200 may be selectively configurable to provide fluid communication from the air inlet 210 to one of the recirculation outlet 212, the first exhaust outlet 214, and the second exhaust outlet 216 without removing or rearranging the air handler 204.

As would be understood, air handler 204 may be provided as any suitable blower or fan (e.g., radial fan, tangential fan, etc.) positioned within hood casing 116 to actively rotate or motivate air, steam, or vapors 400 into and through air inlet 210. Optionally, one or more filters (not pictured) may be provided at inlet 210 to clean the air, steam, or vapors 400 as it enters hood casing 116 from the open region 130. For instance, a grease filter having a suitable coarse filter medium, such as a metallic mesh including aluminum or stainless steel, may be mounted across inlet 210. Additionally or alternatively, an odor filter having a suitable fine filter medium, such as a mesh or block including activated carbon, may be mounted across inlet 210. Optionally, the odor filter may be positioned above or downstream from the grease filter.

As shown in FIGS. 4 through 6, a ventilation duct 202 is defined within the hood casing 116. When air handler 204 is activated, heat, steam, or vapors 400 may be motivated by air handler 202 from open region 130 (FIG. 2) through inlet 210 into ventilation duct 202. As shown, the ventilation duct 202 extends between the inlet 210 and one or more of the air outlet(s) 212, 214, and/or 216. The ventilation duct 202 may be partially defined by a back wall 140 of the casing 116. In at least some configurations, the ventilation duct may be partially defined by one or more internal walls of the casing 116. For example, as illustrated in FIG. 4, the ventilation duct 202 may be defined downstream of the air handler 204 by a vertical wall 242 and between the vertical wall 242 and the recirculation outlet 212 by a transition wall 244 and a top plate 246 proximate the recirculation outlet 212. The ventilation duct 202 may also be partially defined by a removable air guide 218. As described in more detail below, the selective configuration of the ventilation system 200 may be provided by the removable air guide 218 and/or an external vent attachment 224, where a position of the removable air guide 218 and/or the external vent attachment 224 provides fluid communication from the inlet 210 to a selected one of the recirculation outlet 212, the first exhaust outlet 214, and the second exhaust outlet 216.

The ventilation duct 202 may provide fluid communication from the air inlet 210 to the recirculation outlet 212 when the removable air guide 218 is installed in an oblique position, as shown in FIG. 4, where a flow of air 400 exiting the air handler 204 is directed to the recirculation outlet 212 by the removable air guide 218 in the oblique position. As can be seen in FIG. 4, the oblique position of the removable air guide 218 forms an oblique angle with at least two of the vertical direction V, the lateral direction L, and the transverse direction T. Also as may be seen in FIG. 4, when in the oblique position, the removable air guide 218 extends between and across the first and second exhaust outlets 214 and 216, upstream from the first and second exhaust outlets 214 and 216 whereby the removable air guide 218 obstructs airflow to the first and second exhaust outlets 214 and 216 when the removable air guide 218 is in the oblique position. Accordingly, when the removable air guide 218 is in the oblique position, air 400 in the ventilation duct only flows to the recirculation outlet 212. The removable air guide 218 extends between a first end 220 and a second end 222. When in the oblique position of FIG. 4, the removable air guide 218 is removably fastened to a top shelf 248 of the ventilation duct 202 at the first end 220 of the removable air guide 218. For example, one or more screws, bolts or other removable fasteners, which are generally understood by those of skill in the art, may be provided to removably fasten the first end 220 of the removable air guide 218 to the top shelf 248. Such removable fasteners are not shown or described in further detail herein for the sake of brevity and clarity. Also when in the oblique position, the removable air guide 218 forms an interference fit with a guide lip 144 at the second end 222 of the removable air guide 218. As shown, the second end 222 of the removable air guide 218 fits underneath the guide lip 144, e.g., upstream of the guide lip 144, such that air 400 pushing on the removable air guide 218 urges the removable air guide 218 towards the guide lip 144.

As shown in FIGS. 5 and 6, the ventilation system 200 may be configured to provide fluid communication from the air inlet 210 to one of the first exhaust outlet 212 and the second exhaust outlet 214 when the removable air guide 218 is installed in a vertical position. As seen in FIGS. 5 and 6, the removable air guide 218 is aligned generally along the vertical direction V when in the vertical position. The removable air guide 218 may be removably fastened to the top wall 148 of the casing 116, e.g., at the first end 220 of the removable air guide 218, in a similar manner as described above with respect to the top shelf 248, when in the oblique position.

Also shown in FIGS. 5 and 6, the ventilation system 200 may include an external vent attachment 224. As illustrated in FIG. 5, the ventilation system 200 may provide fluid communication from the air inlet 210 to the first exhaust outlet 216 when the removable air guide 218 is installed in the vertical position and the external vent attachment 224 is installed in a vertical position. As illustrated in FIG. 6, the ventilation system 200 may provide fluid communication from the air inlet 210 to the second exhaust outlet 216 when the removable air guide 218 is installed in the vertical position and the external vent attachment 224 is installed in a transverse position. The external vent attachment 224 may include a first leg 226 extending between a free end 228 and a fixed end 230 and a second leg 232 extending between a free end 234 and a fixed end 236. The fixed end 230 of the first leg 226 may be joined to the fixed end 236 of the second leg 232 to form an orthogonal joint 238. An exhaust damper 240 may be defined in the first leg 226. The exhaust damper 240 of the external vent attachment 224 may be oriented along the vertical direction V when the external vent attachment 224 is installed in the vertical position (FIG. 5). The exhaust damper 240 of the external vent attachment 224 may be oriented along the transverse direction T when the external vent attachment 224 is installed in the transverse position (FIG. 6).

As may be seen in FIGS. 5 and 6, the first leg 226 and the second leg 232 of the external vent attachment 224 may be generally equivalent in length. For example, the free end 228 of the first leg 226 may be spaced from the orthogonal joint 238 by an equal distance as the free end 234 of the second leg 232. Further, the first exhaust outlet 214 and the second exhaust outlet 216 may each extend an equal distance from a top rear edge 150 of the casing 116. Accordingly, when the external vent attachment 224 is installed, the second leg 232 will obstruct air 400 flow from one of the first exhaust outlet 214 and the second outlet 216, while the exhaust damper 240 of the first leg 226 will permit air 400 to flow from the other of the first and second exhaust outlets 214 and 216.

Additionally, the first leg 226 may extend perpendicularly to the second leg 232. For example, when the external vent attachment 224 is installed in the vertical position, the first leg 226 extends along the transverse direction T, and the second leg 232 extends along a perpendicular direction, e.g. the vertical direction V, as shown in FIG. 5. Conversely, when the external vent attachment 224 is installed in the transverse position, the first leg 226 extends along the vertical direction V and the second leg 232 extends along the transverse direction T, as shown in FIG. 6.

As illustrated, at least a portion of ventilation duct 202 may be tapered downstream from air handler 204. For instance, top plate 246 may be angled and positioned proximate to top end 118 within ventilation duct 202. Angled top plate 246 may extend, for instance downward, from recirculation outlet 212, thereby reducing the cross-sectional area of ventilation duct 202 and accelerating the flow rate of air or exhaust gases 400 upstream of recirculation outlet 212. As air or exhaust gases 400 flow from recirculation outlet 212, the accelerated flow rate induced by angled top plate 246 may advantageously prevent or reduce exhaust gases 400 from flowing to and impinging on nearby cabinetry.

Figure 7:
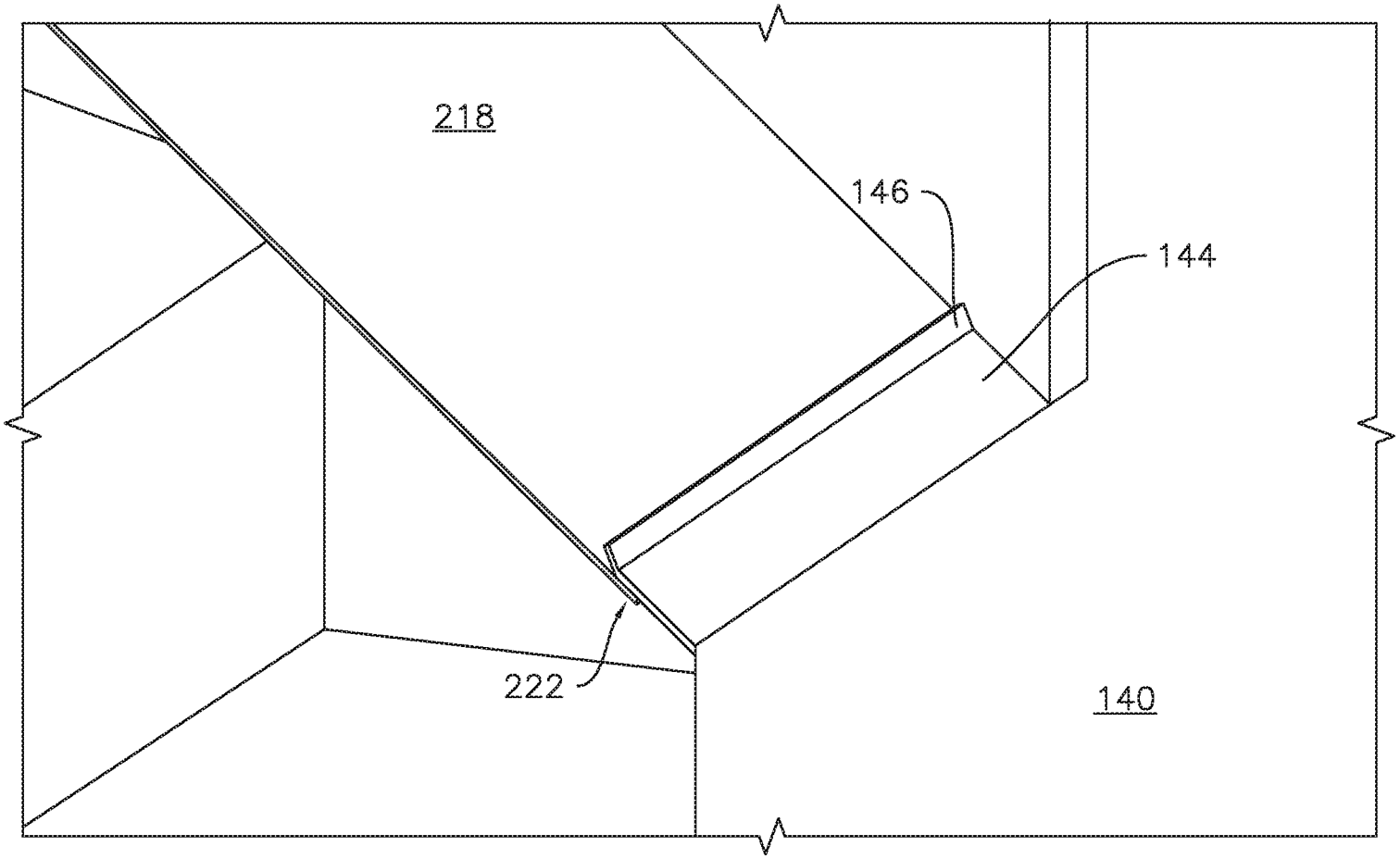
FIG. 7 provides an enlarged view of a portion of the interactive assembly of FIG. 3.

As shown in FIG. 7, the guide lip 144 may include a flared end 146. In such embodiments, the angle of the flared end 146 may direct the second end 222 of the removable air guide 218 into position underneath the guide lip 144 when the removable air guide 218 is installed from the outside of the casing 116 through the first exhaust outlet 214. Moreover, the guide lip 144 may be positioned and configured to form an interference fit with the second end 222 of the removable air guide 218. For example, the orientation of the removable air guide 218 when in the oblique position may be determined by an angle of the top shelf 248 and the guide lip 144 may be positioned relative to the top shelf 248 such that an interference fit is formed between the second end 222 of the removable air guide 218 and the guide lip 144 when the first end 220 of the removable air guide 218 is fastened to the top shelf 248.

Figure 8:
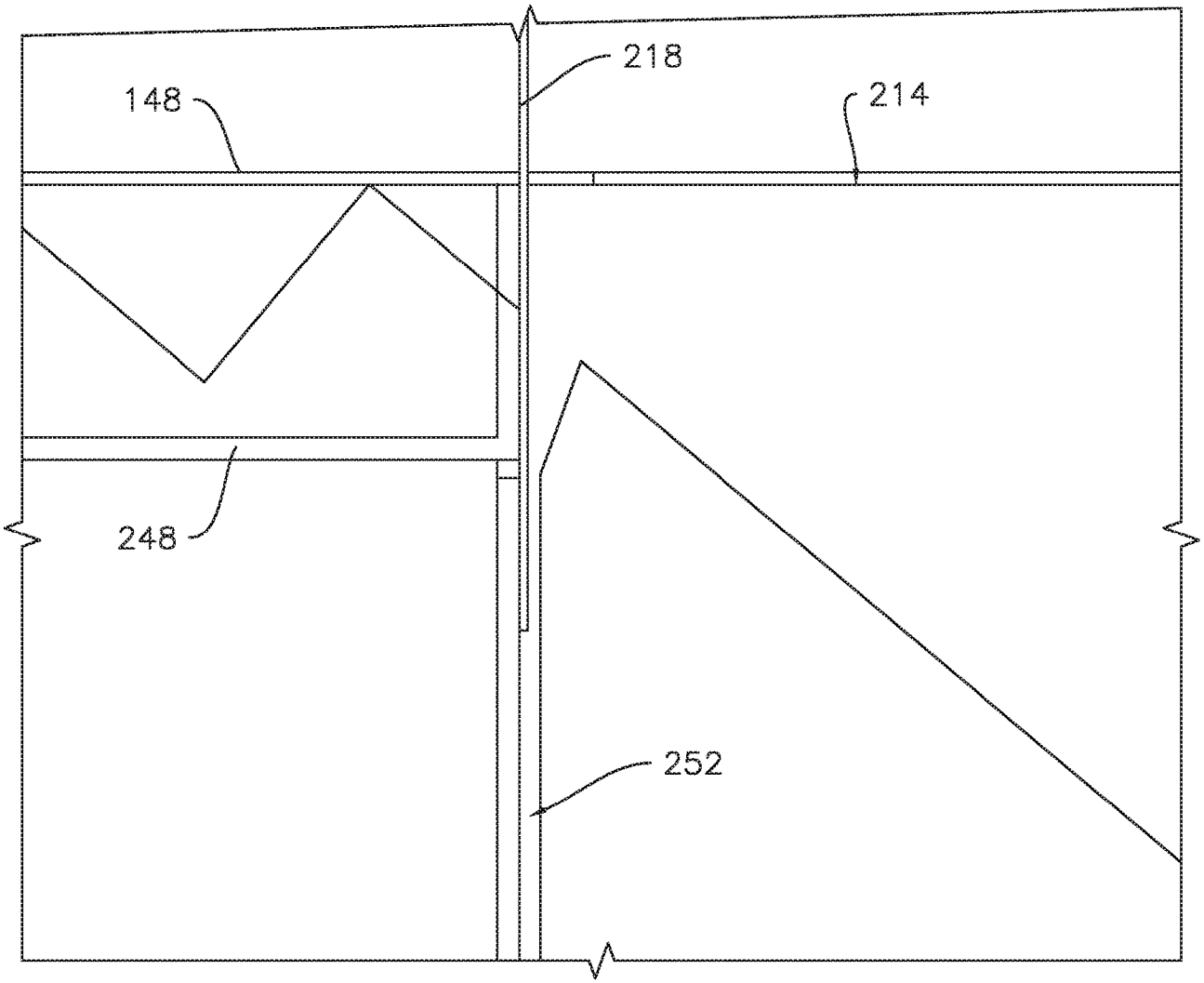
FIG. 8 provides an enlarged view of a portion of the interactive assembly of FIG. 3 with the removable air guide received in a vertical channel.

As shown in FIG. 8, the second end 222 of the removable air guide 218 may be received within a vertical channel 252 when the removable air guide 218 is installed in the vertical position. The vertical channel 252 may extend along the vertical direction V to or near the top end 118 of the casing 116. Accordingly, the removable air guide 218 may be easily installed into the vertical position from outside of the casting 116. The channel 252 may receive the second end 222 of the removable air guide 218 near the top end 118 of the casing 116 and the vertical channel 252 may extend to or near the air handler 204 such that the removable air guide 218 travels within the channel 252 over a substantial portion of a distance travelled by the removable air guide 218 from the first exhaust outlet 216 when the removable air guide 218 is installed into the vertical position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A ventilation system for a cooking engagement system for a cooktop appliance, the ventilation system comprising:

a casing defining a vertical direction, a lateral direction, and a transverse direction;

an air inlet defined in a bottom end of the casing facing the cooktop appliance;

a recirculation outlet defined in a top end of the casing proximate a front end of the casing;

a first exhaust outlet defined in the top end of the casing proximate a back end of the casing;

a second exhaust outlet defined in the back end of the casing proximate the top end of the casing;

a guide lip that extends inward from a bottom edge of the second exhaust outlet and is oblique with respect to the transverse direction; and an air handler fixedly mounted within the casing in fluid communication with the air inlet to motivate an airflow therethrough;

wherein the air handler is permanently fixed to the casing such that an outlet of the air handler is orientated in the vertical direction toward a top of the casing, and wherein the ventilation system is selectively configurable to provide fluid communication from the air inlet to one of the recirculation outlet, the first exhaust outlet, and the second exhaust outlet.

2. The ventilation system of claim 1, further comprising a ventilation duct extending between the air inlet and one of the recirculation outlet, the first exhaust outlet, and the second exhaust outlet.

3. The ventilation system of claim 2, wherein the ventilation duct is partially defined by a removable air guide.

4. The ventilation system of claim 3, wherein the ventilation system is configured to provide fluid communication from the air inlet to the recirculation outlet when the removable air guide is installed in an oblique position relative to the transverse direction.

5. The ventilation system of claim 3, wherein the ventilation system is configured to provide fluid communication from the air inlet to one of the first exhaust outlet and the second exhaust outlet when the removable air guide is installed in a vertical position.

6. The ventilation system of claim 3, further comprising an external vent attachment, wherein the ventilation system is configured to provide fluid communication from the air inlet to the first exhaust outlet when the removable air guide is installed in a vertical position and the external vent attachment is installed in a vertical position.

7. The ventilation system of claim 3, further comprising an external vent attachment, wherein the ventilation system is configured to provide fluid communication from the air inlet to the second exhaust outlet when the removable air guide is installed in a vertical position and the external vent attachment is installed in a transverse position.

8. A ventilation system for a cooktop appliance comprising a cooktop surface, the ventilation system defining a vertical direction, a lateral direction, and a transverse direction, the ventilation system comprising:

a casing positioned above and spaced apart from the cooktop appliance along the vertical direction;

an image monitor supported on the casing at a front end of the casing; and a ventilation assembly comprising:

an air inlet defined in a bottom end of the casing facing the cooktop surface of the cooktop appliance;

a recirculation outlet defined in a top end of the casing proximate the front end of the casing;

a first exhaust outlet defined in the top end of the casing proximate a back end of the casing;

a second exhaust outlet defined in the back end of the casing proximate the top end of the casing;

a guide lip that extends inward from a bottom edge of the second exhaust outlet and is oblique with respect to the transverse direction; and an air handler fixedly mounted within the casing in fluid communication with the air inlet to motivate an airflow therethrough;

wherein the air handler is permanently fixed to the casing such that an outlet of the air handler is orientated in the vertical direction toward a top of the casing, and wherein the ventilation assembly is selectively configurable to provide fluid communication from the air inlet to one of the recirculation outlet, the first exhaust outlet, and the second exhaust outlet.

9. The ventilation system of claim 1, wherein the ventilation assembly further comprises a ventilation duct extending between the air inlet and one of the recirculation outlet, the first exhaust outlet, and the second exhaust outlet.

10. The ventilation system of claim 9, wherein the ventilation duct is partially defined by a removable air guide.

11. The ventilation system of claim 10, wherein the ventilation assembly is configured to provide fluid communication from the air inlet to the recirculation outlet when the removable air guide is installed in an oblique position relative to the transverse direction.

12. The ventilation system of claim 11, wherein the removable air guide is removably fastened to a top shelf of the ventilation duct at a first end of the removable air guide and the removable air guide forms an interference fit with the guide lip at a second end of the removable air guide when the removable air guide is installed in the oblique position relative to the transverse direction.

13. The ventilation system of claim 10, wherein the ventilation assembly is configured to provide fluid communication from the air inlet to one of the first exhaust outlet and the second exhaust outlet when the removable air guide is installed in a vertical position.

14. The ventilation system of claim 13, wherein the removable air guide is removably fastened to a top wall of the casing at a first end of the removable air guide and a second end of the removable air guide is received within a vertical channel when the removable air guide is installed in the vertical position.

15. The ventilation system of claim 10, further comprising an external vent attachment, wherein the ventilation system is configured to provide fluid communication from the air inlet to the first exhaust outlet when the removable air guide is installed in a vertical position and the external vent attachment is installed in a vertical position.

16. The ventilation system of claim 15, wherein the external vent attachment comprises a first leg extending between a free end and a fixed end, a second leg extending between a free end and a fixed end, the fixed end of the first leg joined to the fixed end of the second leg to form an orthogonal joint, and an exhaust damper defined in the first leg, and wherein the exhaust damper of the external vent attachment is oriented along the vertical direction when the external vent attachment is installed in the vertical position.

17. The ventilation system of claim 10, further comprising an external vent attachment, wherein the ventilation assembly is configured to provide fluid communication from the air inlet to the second exhaust outlet when the removable air guide is installed in a vertical position and the external vent attachment is installed in a transverse position.

18. The ventilation system of claim 17, wherein the external vent attachment comprises a first leg extending between a free end and a fixed end, a second leg extending between a free end and a fixed end, the fixed end of the first leg joined to the fixed end of the second leg to form an orthogonal joint, and an exhaust damper defined in the first leg, and wherein the exhaust damper of the external vent attachment is oriented along the transverse direction when the external vent attachment is installed in the transverse position.

* * * * *